US008899933B2

(12) United States Patent
Farineau et al.

(10) Patent No.: US 8,899,933 B2
(45) Date of Patent: Dec. 2, 2014

(54) ROTOR BLADE MOUNTING

(75) Inventors: Thomas Joseph Farineau, Schoharie, NY (US); Robert Edward Deallenbach, Flat Rock, NC (US); Timothy Scott McMurray, Fultonville, NY (US)

(73) Assignee: General Electric Company, Schenectady, NY (US)

( * ) Notice: Subject to any disclaimer, the term of this patent is extended or adjusted under 35 U.S.C. 154(b) by 471 days.

(21) Appl. No.: 13/342,555

(22) Filed: Jan. 3, 2012

(65) Prior Publication Data

US 2013/0170996 A1 Jul. 4, 2013

(51) Int. Cl.
*F01D 5/30* (2006.01)
*F01D 5/32* (2006.01)

(52) U.S. Cl.
CPC ..... *F01D 5/3038* (2013.01); *F01D 5/32* (2013.01)
USPC .... 416/215; 416/216; 416/219 R; 416/220 R; 416/239; 416/248

(58) Field of Classification Search
CPC ..... F01D 5/3038; F01D 5/32
USPC ..... 416/215, 216, 219 R, 220 R, 239, 248
See application file for complete search history.

(56) References Cited

U.S. PATENT DOCUMENTS

| | | | | | |
|---|---|---|---|---|---|
| 3,042,368 | A * | 7/1962 | Cook | 416/216 |
| 3,088,708 | A * | 5/1963 | Feinberg | 416/215 |
| 3,216,700 | A * | 11/1965 | Bostock | 416/216 |
| 3,721,506 | A * | 3/1973 | Anderson | 416/215 |
| 3,778,191 | A * | 12/1973 | Brockmann | 416/215 |
| 4,255,086 | A * | 3/1981 | Roberts | 416/218 |
| 4,676,723 | A | 6/1987 | Kiger et al. | |
| 4,684,325 | A * | 8/1987 | Arnold | 416/215 |
| 4,710,103 | A | 12/1987 | Faber et al. | |
| 7,168,919 | B2 | 1/2007 | Blatchford et al. | |
| 7,901,187 | B2 * | 3/2011 | Barber | 416/216 |
| 8,206,116 | B2 * | 6/2012 | Pickens et al. | 416/215 |

* cited by examiner

*Primary Examiner* — Igor Kershteyn
(74) *Attorney, Agent, or Firm* — Ernest G. Cusick; Hoffman Warnick LLC

(57) ABSTRACT

A wheel dovetail groove with a wheel hook retains blade hooks of mounted blades. Opposed arcuate cut-outs in upper recessed areas of the groove may form an assembly gate. Blade hooks may be inserted into the groove in a first orientation, rotated to a second orientation at the assembly gate, and slid into a predetermined position. Blades may be secured with shims between adjacent bucket dovetails. Blade tip cover blocks may be included to form a cover. All blades may be substantially identical and not need special mounting arrangements at the assembly gate.

19 Claims, 18 Drawing Sheets

ROTOR BLADE MOUNTING

BACKGROUND OF THE INVENTION

The disclosure relates generally to rotor assemblies, and more particularly to blade or bucket mounting in turbine rotors.

A rotor includes a plurality of blades or buckets whose roots are typically mounted on a rotating body, such as a shaft or the like, often referred to as a wheel. Each blade or bucket root may include a profile that is typically shaped to be retained against radial motion when mounted in a groove in the body so that the blade may slide in the groove but not come out of the groove. For example, the blade root and groove may include complementary dovetails including a bucket or blade hook and a wheel hook that cooperate to retain the bucket dovetails in the groove. To enable insertion of the bucket roots into the groove, the blade hook region is typically cut to form an assembly gate. The assembly gate is generally one bucket width along the circumference. Special arrangements must be made to retain the blade(s) at the assembly gate. The assembly gate is typically cut through wheel hooks in the groove, which may reduce the load bearing capacity of the gate area. Additionally, natural frequencies of the rotor may be affected by the assembly gate, as may balancing of the rotor.

BRIEF DESCRIPTION OF THE INVENTION

Embodiments of the invention disclosed herein may take the form of a blade mounting system that may include a blade including a bucket dovetail, the bucket dovetail including a blade hook portion. A wheel dovetail groove formed in a rotor may have a shape complementary to that of the bucket dovetail and include an assembly gate. The bucket dovetail may be configured to have a first orientation in which the blade hook portion will fit through the assembly gate and a second orientation in which the blade hook portion is retained by the wheel dovetail groove. In addition, the bucket dovetail may be configured to rotate between the first orientation and the second orientation at the assembly gate and to be restrained against rotation at other locations in the wheel dovetail groove.

Another embodiment may include a rotor blade mounting arrangement with a rotor that has a substantially cylindrical surface. A wheel dovetail may be formed in the rotor through the substantially cylindrical surface. The wheel dovetail may include a substantially circumferential groove in the rotor, a wheel neck shoulder, and an upper recessed area at an opening of the groove. A rotor blade may include a bucket dovetail configured to support the rotor blade and to be retained against radial movement in and by the wheel dovetail. A blade hook shoulder of the bucket dovetail may be configured to engage and be retained against exit from the wheel dovetail groove by the wheel neck shoulder. An upper shoulder of the bucket dovetail may be configured to at least partly overlie the wheel neck shoulder. An assembly gate may include a cut-out formed in the upper recessed area of the wheel dovetail groove. The cut-out may be configured to allow the blade hook shoulder to be inserted into the wheel dovetail groove in a first orientation of the bucket dovetail and to allow the upper shoulder to pass when the bucket dovetail is rotated into a second orientation.

Another embodiment may take the form of a rotor including a substantially cylindrical surface of a rotor body and a wheel dovetail including a substantially circumferential groove in the substantially cylindrical surface. A plurality of substantially identical rotor blades may each have a bucket dovetail with a blade hook portion. Each blade hook portion may have a first orientation in which the blade hook portion may be inserted into the groove and a second orientation in which the blade hook portion is retained in the groove and retained against rotation in the groove. Each bucket dovetail may include blade hook shoulders in the blade hook portion and upper shoulders in an upper portion of the bucket dovetail. Opposed wheel neck shoulders may be formed in the groove between a wheel hook portion of the groove and an upper portion of the groove, the wheel neck shoulders being configured to retain a respective blade hook portion of each rotor blade via respective blade hook shoulders. Upper recessed areas may be formed in the top portion of the groove and configured to retain respective upper shoulders of each bucket dovetail against rotation. An assembly gate in the groove may be configured to allow the upper shoulders of each bucket dovetail to pass when the bucket dovetail is rotated to a second orientation in which the bucket dovetail is retained in the groove.

Other aspects of the invention provide methods, systems, program products, and methods of using and generating each, which include and/or implement some or all of the actions described herein. The illustrative aspects of the invention are designed to solve one or more of the problems herein described and/or one or more other problems not discussed.

BRIEF DESCRIPTION OF THE DRAWING

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

The detailed description explains embodiments of the invention, together with advantages and features, by way of example with reference to the drawings.

DETAILED DESCRIPTION OF THE INVENTION

As indicated above, aspects of the invention provide a rotor blade arrangement and assembly method.

Figure 1:
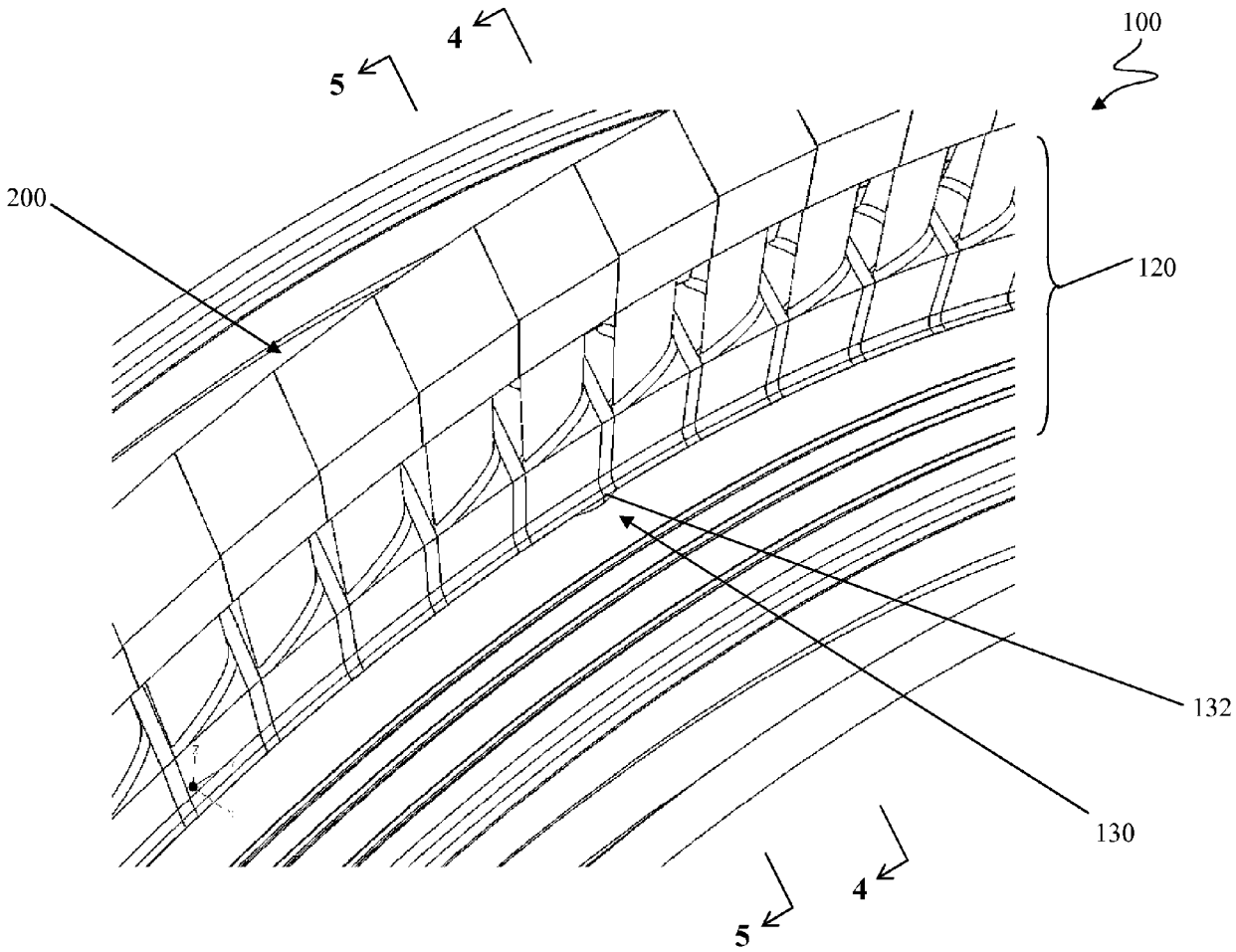
FIG. 1 shows a schematic elevation diagram of a rotor assembly according to embodiments of the invention disclosed herein.

With reference to FIG. 1, embodiments of the invention disclosed herein include a rotor 100 including a plurality of blades or buckets 200 having bucket dovetails 210 securely retained in a blade hook arrangement or dovetail assembly 300 of the rotor 100. An assembly gate 130 may be formed in blade hook arrangement or dovetail assembly 300, such as by forming opposed arcuate cut-outs 132 at a predetermined location along blade hook arrangement or dovetail assembly 300. Rotor 100 may include a substantially cylindrical surface, which may be a surface of an annular body, a cylindrical body, or other suitable body, and rotor 100 may be referred to as a wheel.

Figure 2:
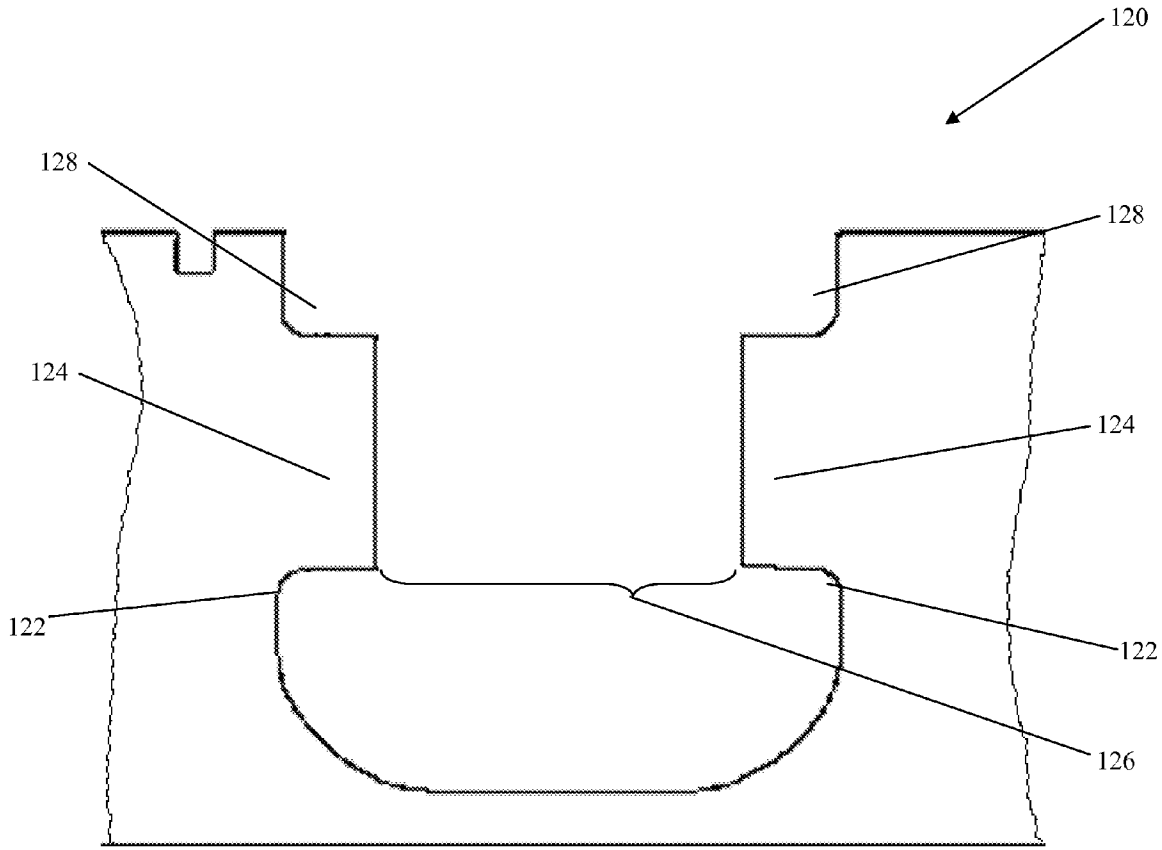
FIG. 2 shows a schematic cross sectional diagram of a wheel dovetail of a dovetail arrangement according to embodiments of the invention disclosed herein.

As seen in FIG. 2, which shows a cross section of blade hook arrangement or dovetail assembly 300, a substantially circumferential dovetail groove 120 may include a wheel neck shoulder 124 formed between a lower portion and an upper portion of dovetail groove 120. In embodiments, opposed wheel neck shoulders 124 may be included to form a gap 126 that is slightly wider than a mating bucket neck width. An upper recessed area 128 above wheel neck shoulder 124 may also be provided for added interaction with bucket dovetail 210 as will be described.

Figure 3:
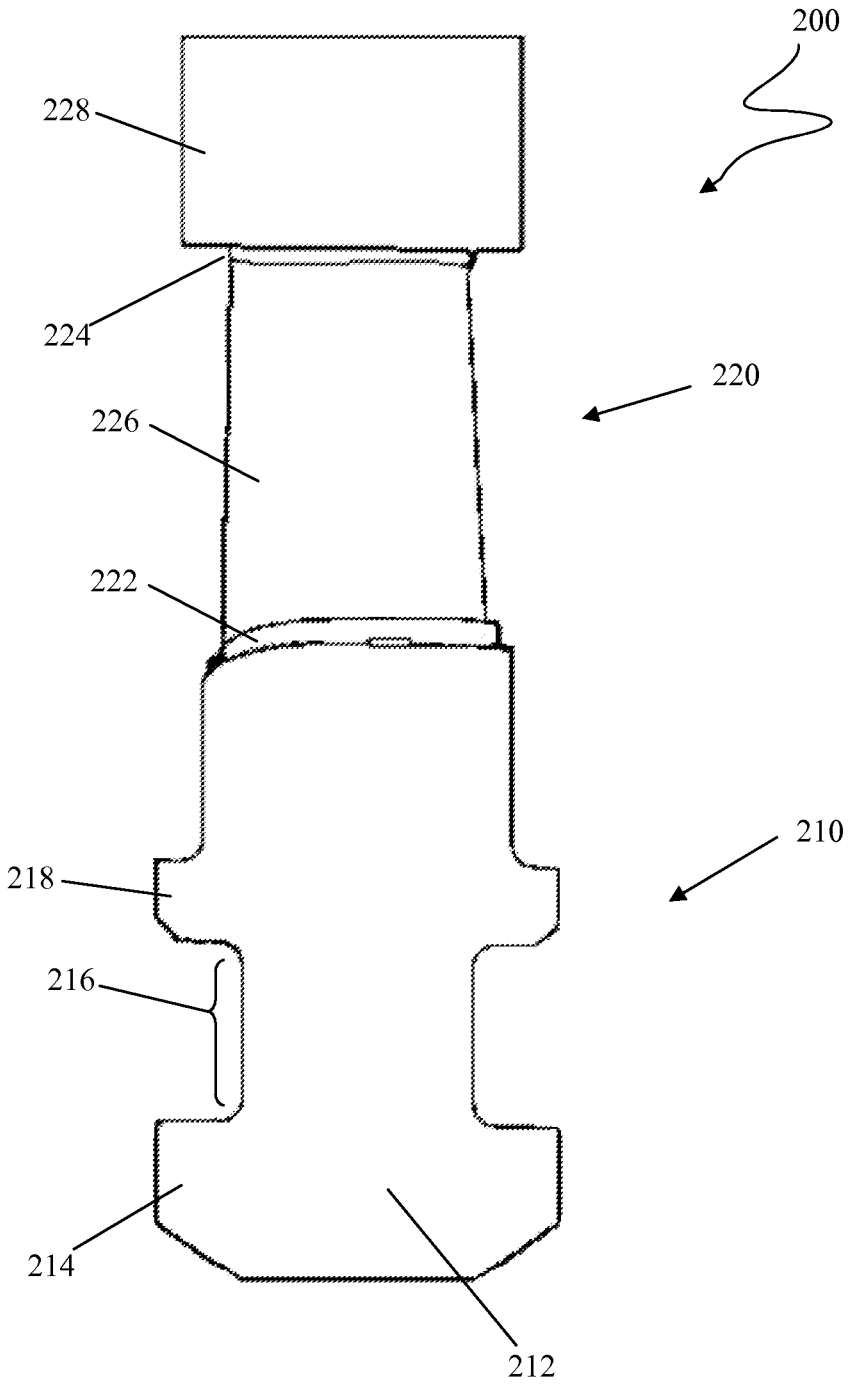
FIG. 3 shows a schematic cross sectional diagram of a bucket according to embodiments of the invention disclosed herein.

A cross section of an example of a bucket or blade 200 including a bucket dovetail 210 and a blade body 220 is seen in FIG. 3. A blade hook portion 212 of bucket dovetail 210 may include blade hook shoulders 214 configured to interact with wheel neck shoulders 124 of blade hook arrangement or dovetail assembly 300 when blade hook portion 212 is in a particular orientation. Blade hook shoulders 214 may engage wheel neck shoulders 124 so that bucket dovetail 210, and a corresponding rotor blade, may be retained against radial motion or motion out of dovetail groove 120. A shaft or neck portion 216 may extend from blade hook portion 212 toward a blade body 220 supported by bucket dovetail 210. In embodiments, bucket dovetail 210 may include upper shoulders or bucket platform 218 in an upper portion of bucket dovetail 210 that may be configured to interact with upper recessed areas 128 of blade hook arrangement or dovetail assembly 300, such as to secure bucket dovetail 210 in position. As also seen in FIG. 3, blade body 220 may include a base 222, attached to or formed on a top portion of bucket dovetail 210, and a tip 224. Blade body 220 may further include a airfoil portion 226 between base 222 and tip 224, which airfoil portion 226 may have a profile that may vary over a length of blade body 220 as may be desired and/or appropriate, such as to improve blade efficiency. In embodiments, tip 224 may support or carry a cover block 228 configured to engage adjacent cover blocks 228 of adjacent blades 220 in an assembly.

Figure 4:
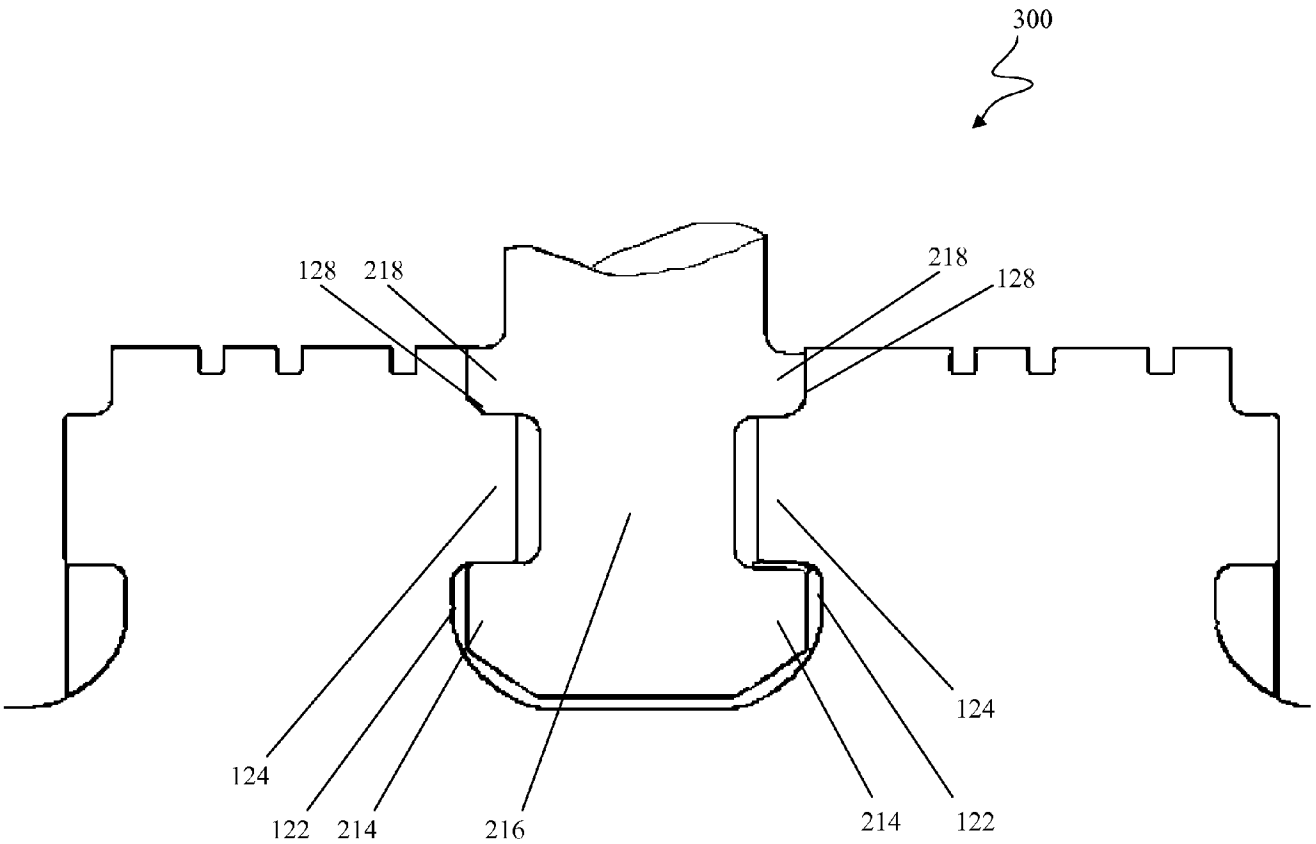
FIG. 4 shows a schematic cross sectional diagram of a dovetail assembly at a location other than at an assembly gate according to embodiments of the invention disclosed herein.

FIG. 4 shows a cross section of a dovetail assembly 300 at a position other than at assembly gate 130. As seen in FIG. 4, blade hook shoulders 214 engage at inboard radial shoulders or bases of wheel neck shoulders 124. This engagement prevents radial motion of bucket dovetail 210 out of wheel dovetail groove 120. In addition, upper shoulders or bucket platform 218 interact(s) with upper recessed areas 128 to both secure the bucket axially and prevent twisting rotation of the bucket. Neck portion 216 connects bucket platform 218 to blade hook 212.

Figure 5:
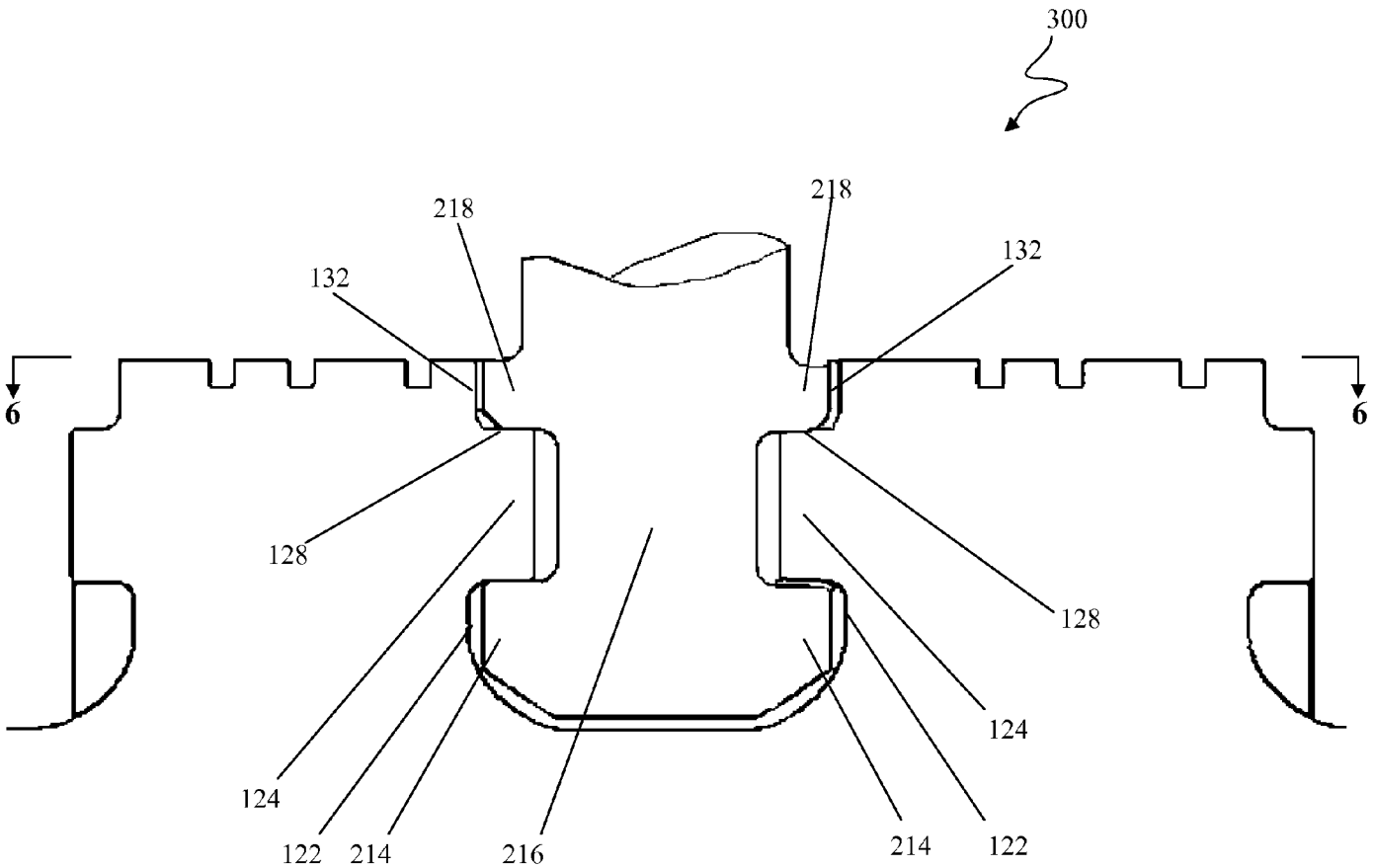
FIG. 5 shows a schematic cross sectional diagram of a dovetail assembly at an assembly gate according to embodiments of the invention disclosed herein.

FIG. 5 shows a cross section of a dovetail assembly 300 according to embodiments at an example of assembly gate 130. As seen in FIG. 5, assembly gate 130 may include opposed arcuate cut-outs 132. As also seen in FIG. 5, the particular arrangement of arcuate cut-outs 132 has at most a negligible effect on integrity of wheel neck shoulders 124 while providing as much engagement of blade hook 214 with wheel neck shoulders 124 at assembly gate 130 as at any other position along dovetail groove 122. Reference may also be had to FIGS. 6-11, which provide additional views of aspects of a rotor according to embodiments.

Figure 8:
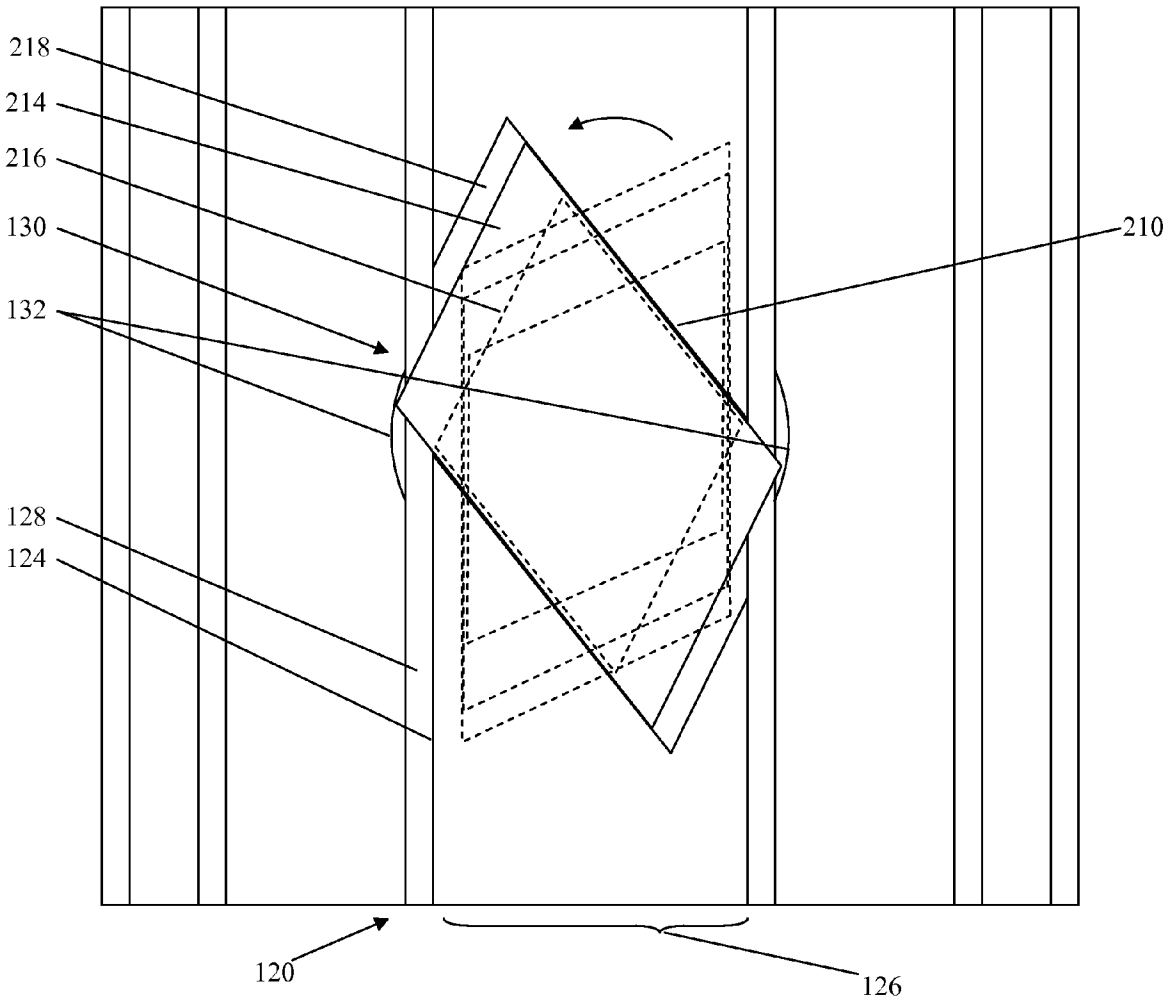
FIG. 8 is a schematic top view of the bucket of FIG. 6 being rotated into a second orientation according to embodiments of the invention disclosed herein.
Figure 9:
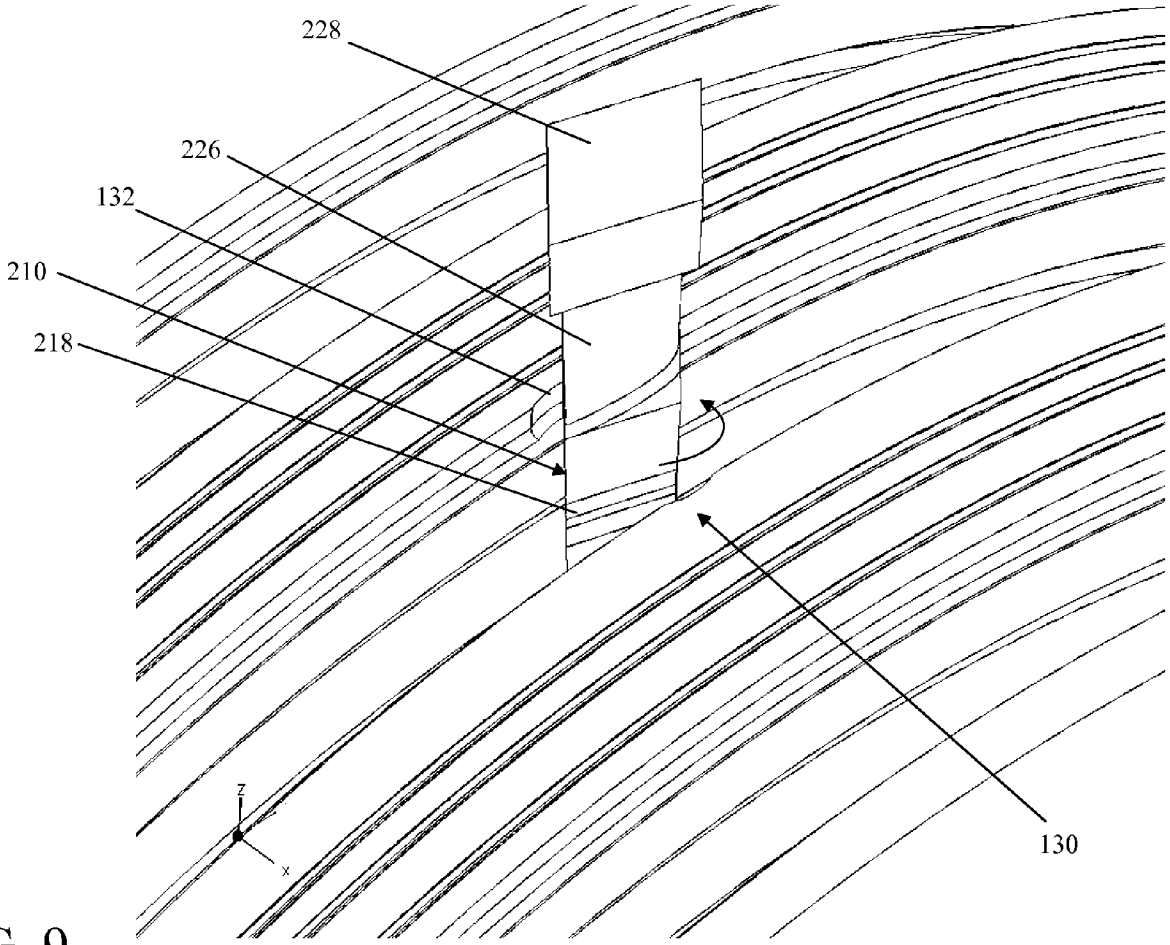
FIG. 9 is a schematic elevation of the bucket of FIG. 8 according to embodiments of the invention disclosed herein.
Figure 10:
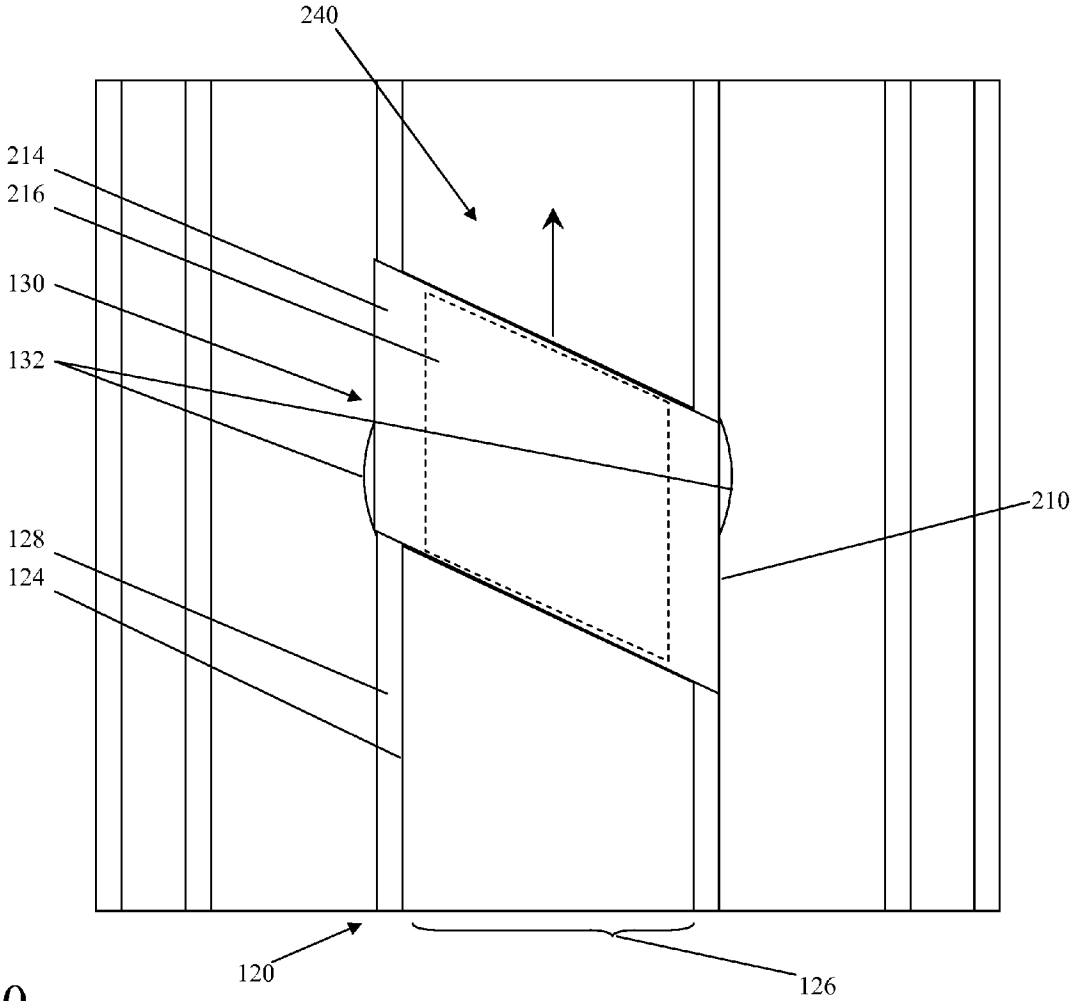
FIG. 10 is a schematic top view of the bucket of FIGS. 6-9 in the second orientation according to embodiments of the invention disclosed herein.
Figure 11:
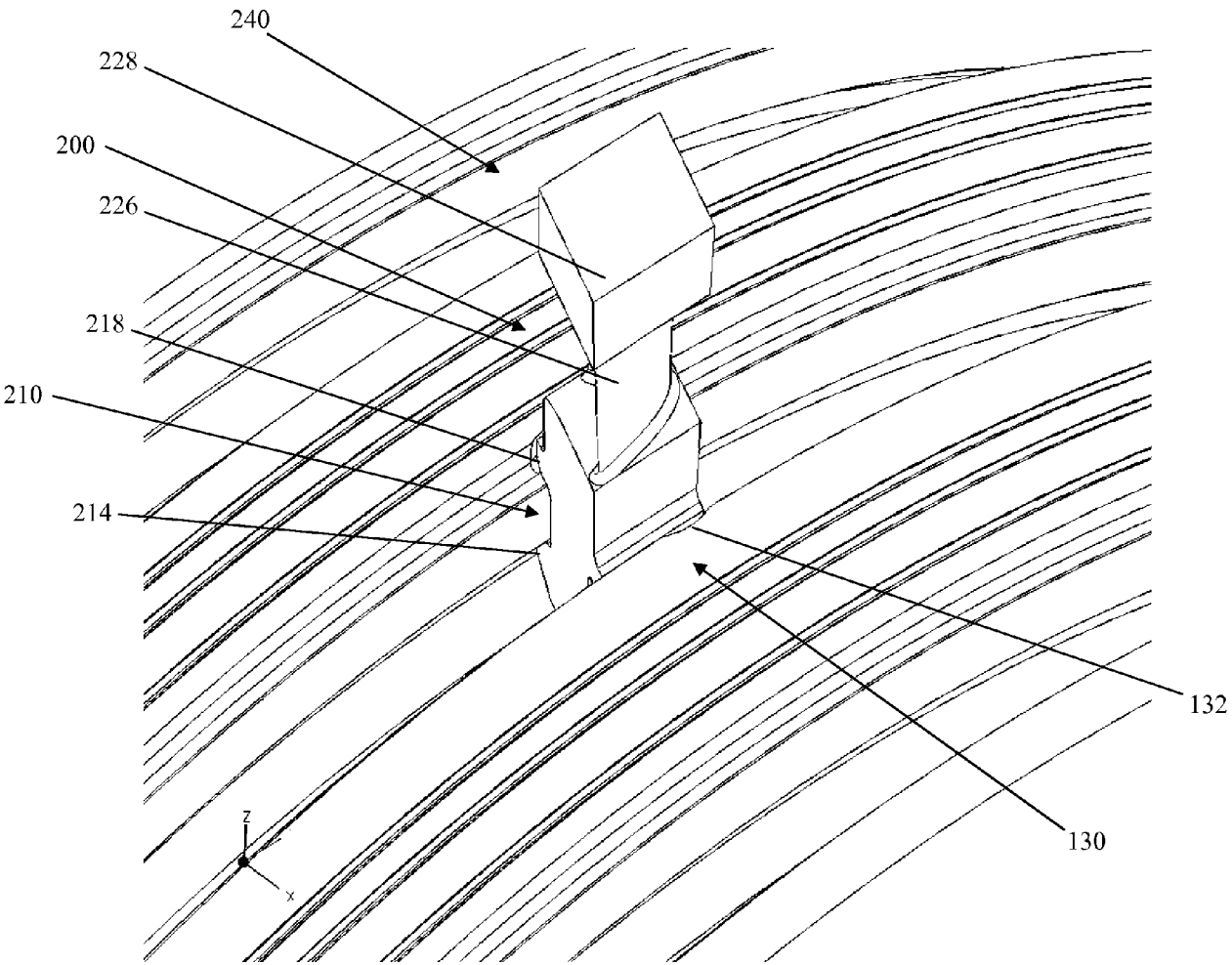
FIG. 11 is a schematic elevation of the bucket of FIG. 10 according to embodiments of the invention disclosed herein.

As seen in FIGS. 6-11, bucket dovetail 210 may be configured to have a first orientation 230 relative to assembly gate 130 and dovetail groove 120 into which bucket dovetail 210 may be inserted through assembly gate 130. When bucket dovetail 210 is inserted to a predetermined depth, such as to a point at which blade hook shoulders 214 clear wheel neck shoulders 124, and/or to a point at which bucket platform 218 will engage upper recessed areas 128, bucket dovetail 210 may be rotated, as seen in FIGS. 8 and 9, toward a second orientation 240 relative to assembly gate 130, shown in FIGS. 10 and 11, in which bucket dovetail 210 will not pass through assembly gate 130 and may be retained by blade hook arrangement or dovetail assembly 300. There is thus an angular offset between first orientation 230 and second orientation 240 that will depend on the geometry of the various parts involved. In second orientation 240, bucket dovetail 210 is retained or restrained against movement out of or exit from dovetail groove 120. In addition, as a result of interaction between sides of bucket platform 218 and upper recessed areas 128, bucket 200 is restrained against rotation in dovetail groove 120 at locations including assembly gate 130 and all other locations around the row. Openings or cut-outs 132 may feature a tangential length less than a pitch of a final or last bucket pitch and, as such, may not significantly compromise the axial and/or twisting restraint capability of the shoulder at the final or last location, assembly gate 130.

Figure 6:
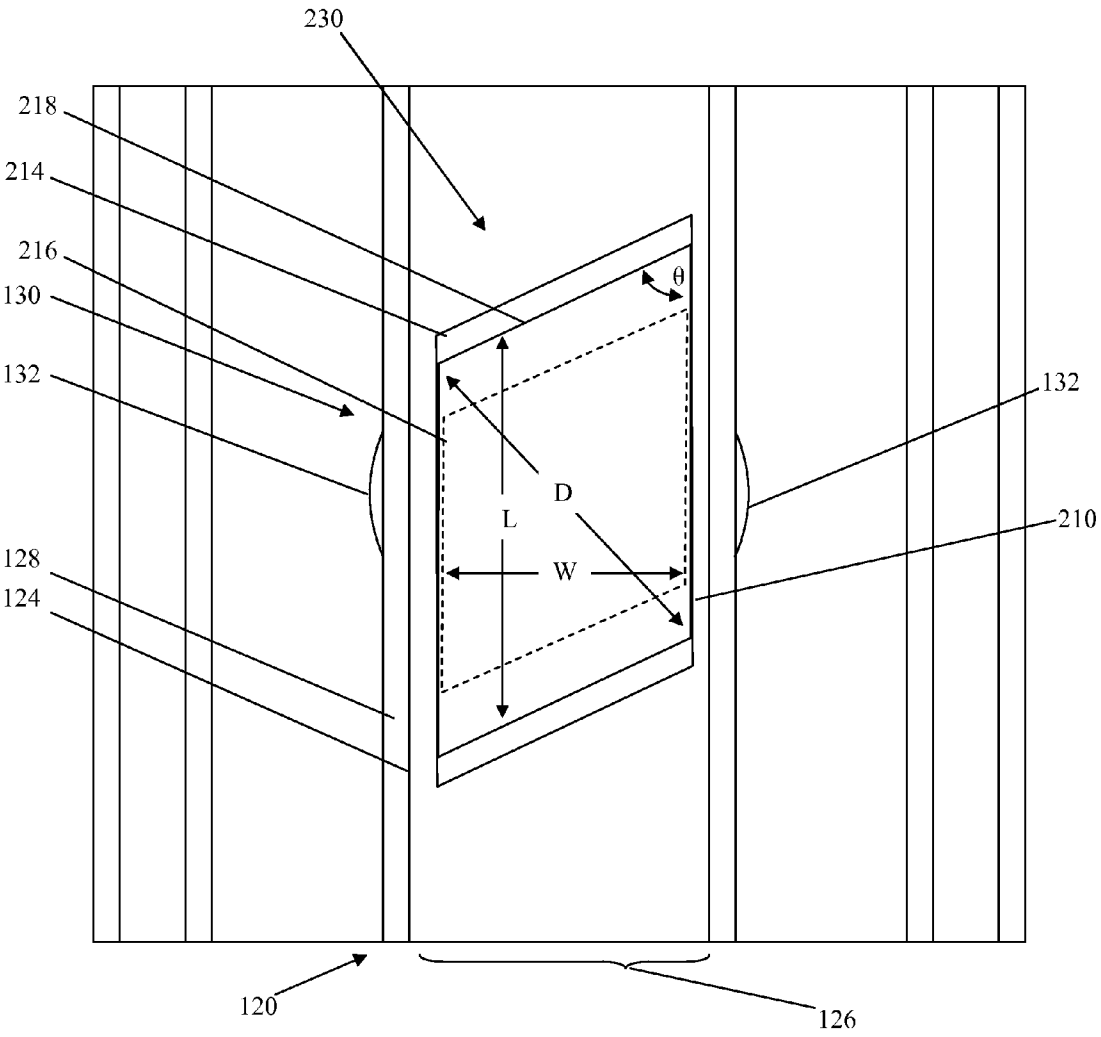
FIG. 6 shows a schematic, partly cross sectional diagram, taken along view line 6-6 of FIG. 5, of a bucket in a first orientation and positioned for insertion into an assembly gate according to embodiments of the invention disclosed herein.
Figure 7:
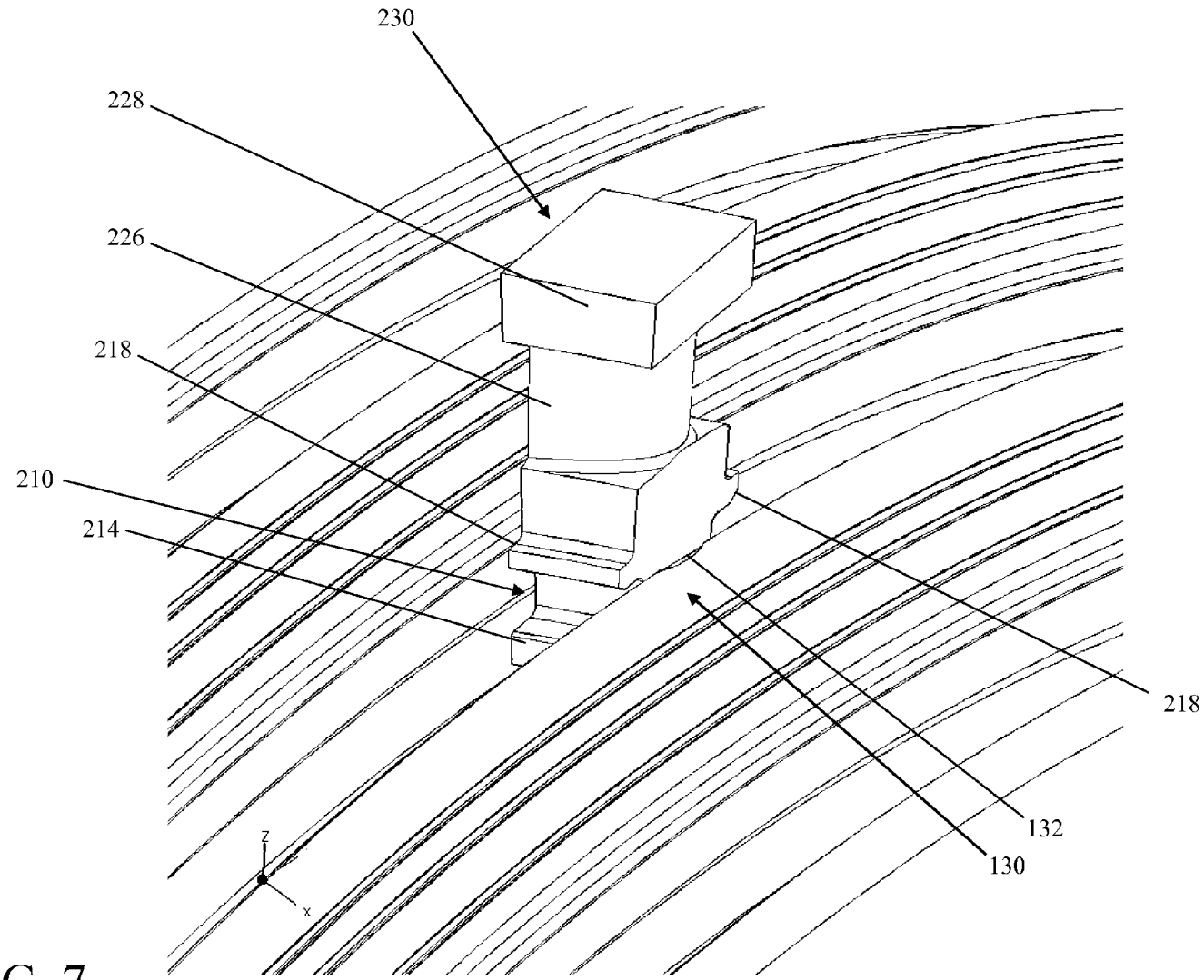
FIG. 7 is a schematic elevation of the bucket of FIG. 6 according to embodiments of the invention disclosed herein.

FIG. 6 in particular shows an example of a configuration that might be employed for bucket dovetail 210. As shown, upper shoulders or bucket platform 218 may have a parallelogram shaped cross section including a length L, a width W, a diagonal D between opposed corners, and an angle θ between two adjacent sides. In addition, blade hook shoulders 214 may also have a parallelogram shaped cross section with a respective length, width, diagonal, and angle. It should be recognized that a second diagonal and a second angle are also present for each cross section, but only one is used for each in the example below for the sake of convenience. In addition, while a parallelogram shaped cross section is employed, other shapes could also be used within the scope of embodiments.

In embodiments, blade hook shoulders 214 may be configured to have a width at least as narrow as gap 126 in first orientation 230 to enable insertion of bucket dovetail 210 into dovetail groove 120. Upper shoulders 218 in embodiments may be configured to have a length and an angle selected so that in second orientation 240 they are held against rotation by upper recessed areas 128. Upper shoulders or bucket platform 218 may also have a width narrower than gap 126 in embodiments. Blade hook shoulders 214 may be configured to have a length and an angle selected so that in second orientation 240 they are held against movement out of dovetail groove 120 by wheel neck shoulders 124, but so that rotation from first orientation 230 to second orientation 240 is not impeded by blade hook shoulders 214. It may be that bucket dovetail 210 may be inserted anywhere along dovetail groove 120, but only at assembly gate 130 will bucket dovetail 210 be able to be rotated into second orientation 240.

As mentioned above, assembly gate 130 may include arcuate cut-outs 132, such as in upper recessed areas 128, to accommodate rotation of bucket dovetail 210. In embodiments in which a parallelogram shaped cross section is used for upper shoulders 218, arcuate cut-outs 132 may be diametrically opposed portions of a circle with a diameter equal to diagonal D of upper shoulders 218 and centered midway between upper recessed areas 128. When a smaller diagonal of upper shoulders 218 is used, rotation past second orientation 240 may be prevented by ends of upper shoulders 218. An offset between first orientation 230 and second orientation 240 may be equal to angle θ.

In the example shown in the FIGS., an offset between first orientation 230 and second orientation 240 may be equal to the smallest angle θ between adjacent sides of the cross section of upper shoulders 218. First orientation 230 may be that in which long sides of blade hook shoulders 214 are parallel to walls of dovetail groove 120, though this may vary depending on how much smaller the width of blade hook shoulders 214 is than gap 126. If angle θ is, for example, 65°, then a rotation of 65° may place bucket dovetail 210 in second orientation 240, which may bring short sides of upper shoulders 218 parallel to and, in embodiments, in engagement with walls in the upper recessed areas. Thus, the offset between first orientation 230 and second orientation 240 when a parallelogram shaped cross section having a smaller angle of 65° may be 65°.

Figure 12:
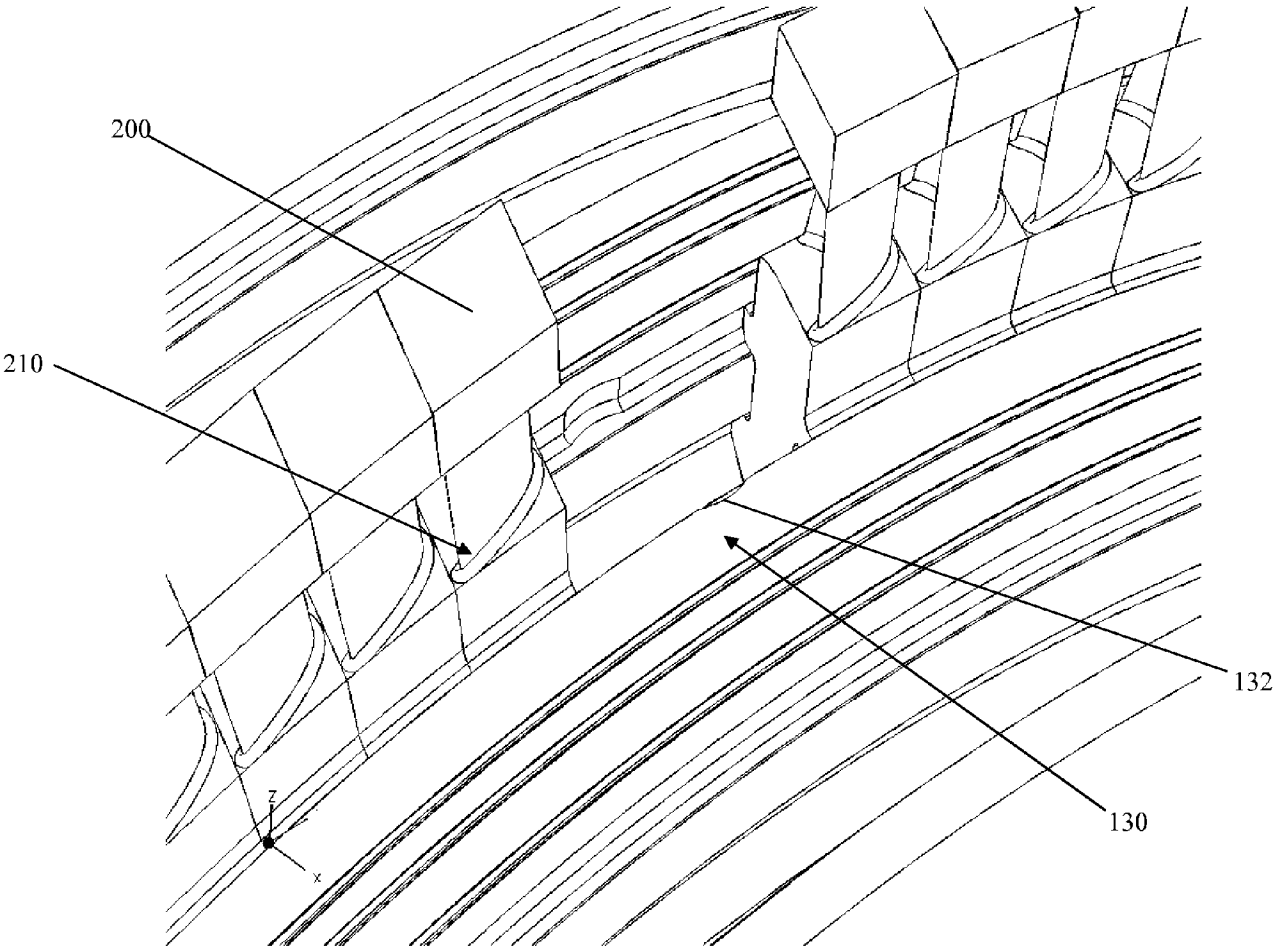
FIG. 12 is a schematic elevation of all but a final bucket arranged in respective second orientations according to embodiments of the invention disclosed herein.
Figure 13:
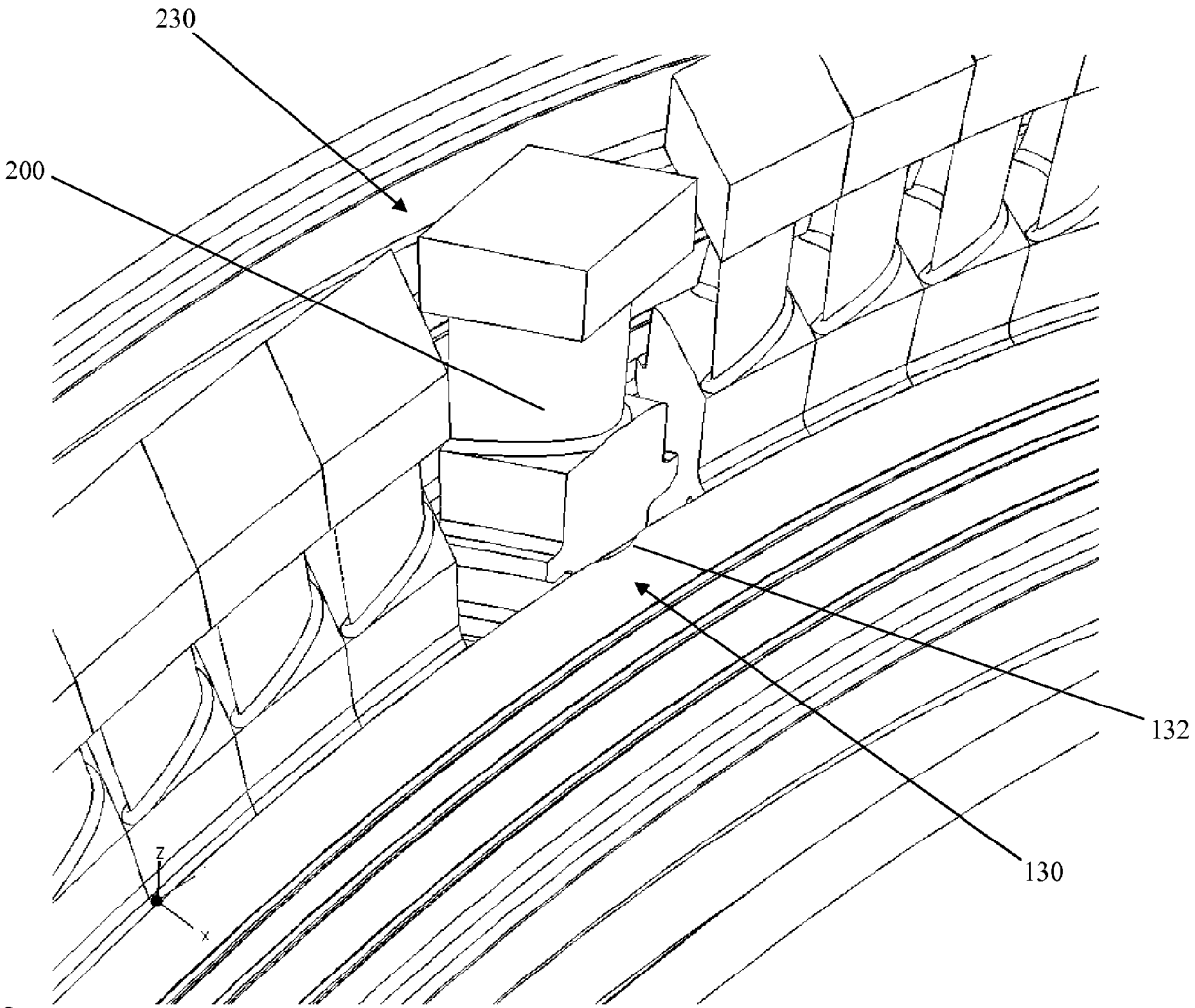
FIG. 13 is a schematic elevation of a final bucket in a first orientation according to embodiments of the invention disclosed herein.
Figure 14:
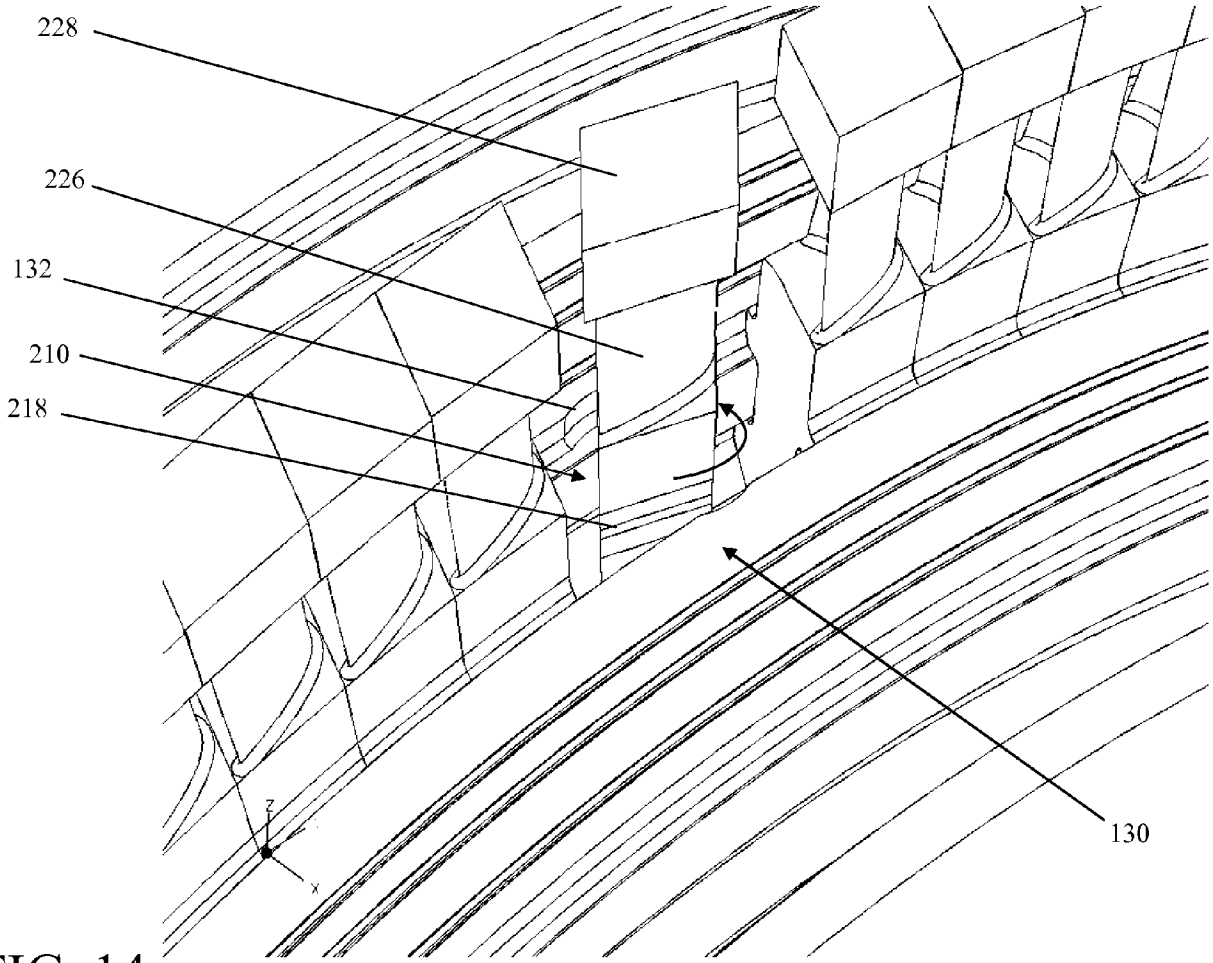
FIG. 14 is a schematic elevation of the final bucket of FIG. 13 being rotated toward a second orientation according to embodiments of the invention disclosed herein.
Figure 15:
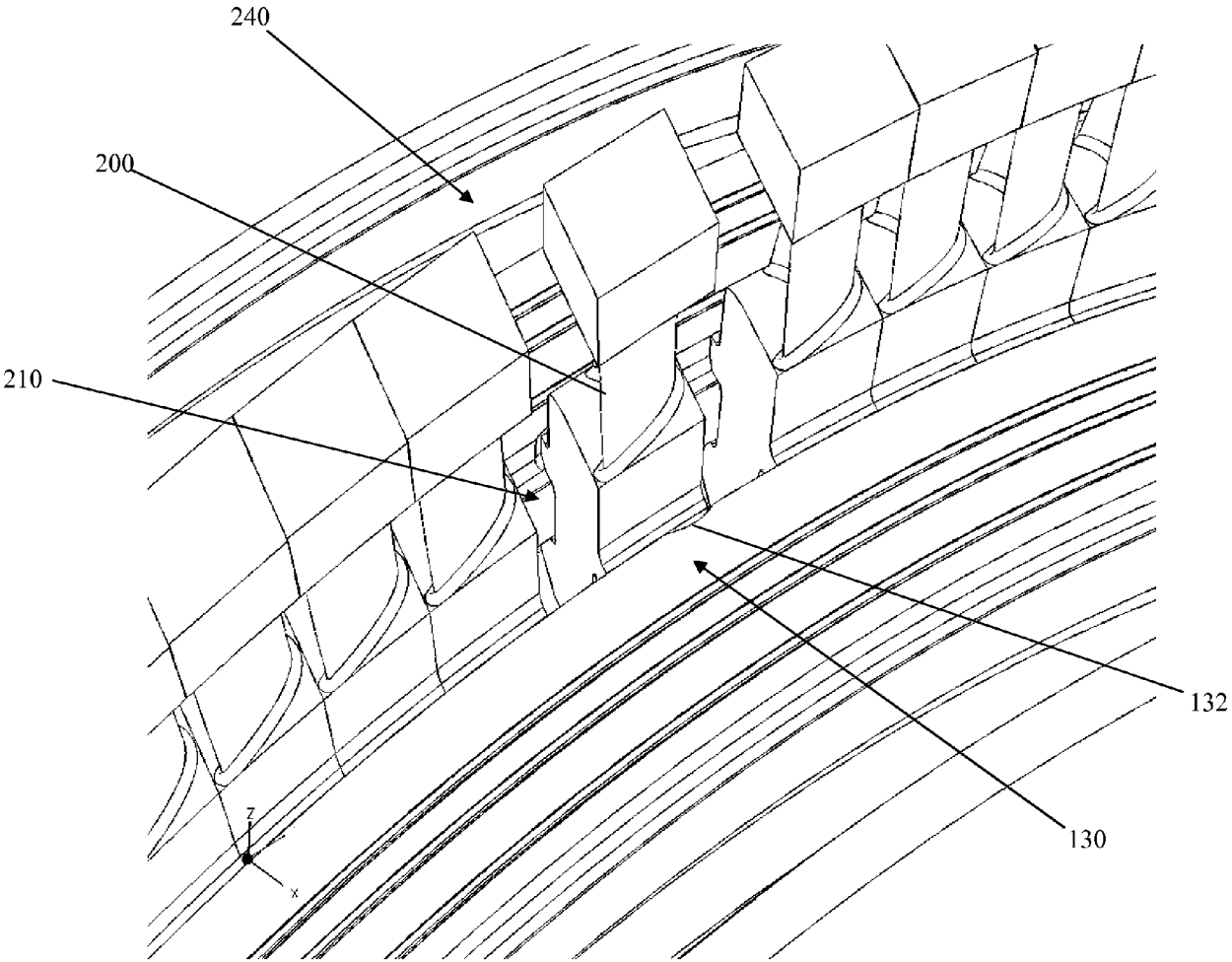
FIG. 15 is a schematic elevation of the final bucket of FIGS. 13-14 in a second orientation according to embodiments of the invention disclosed herein.
Figure 16:
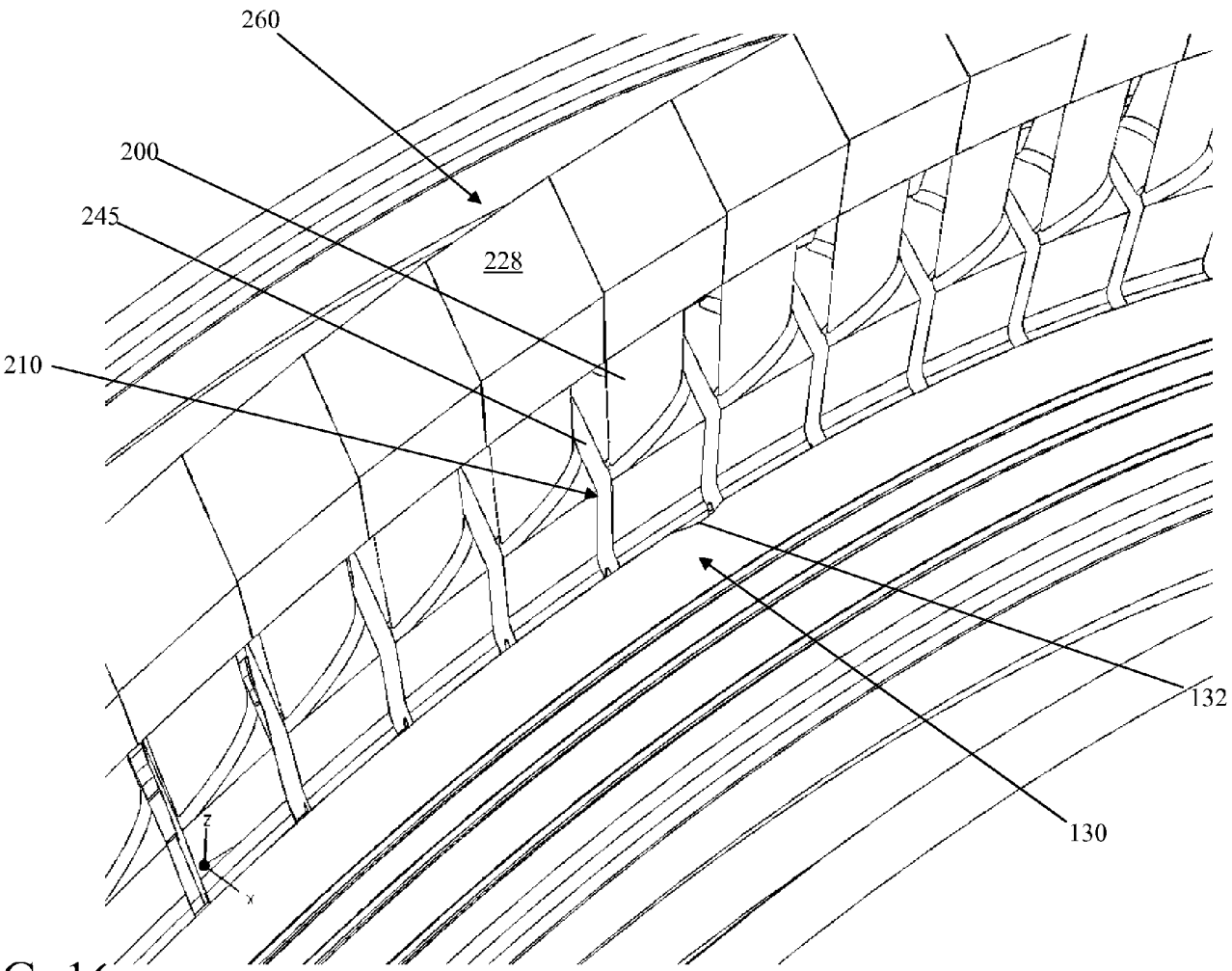
FIG. 16 is a schematic elevation of the buckets of FIGS. 6-15 in respective second orientations with roots spaced apart according to embodiments of the invention disclosed herein.
Figure 17:
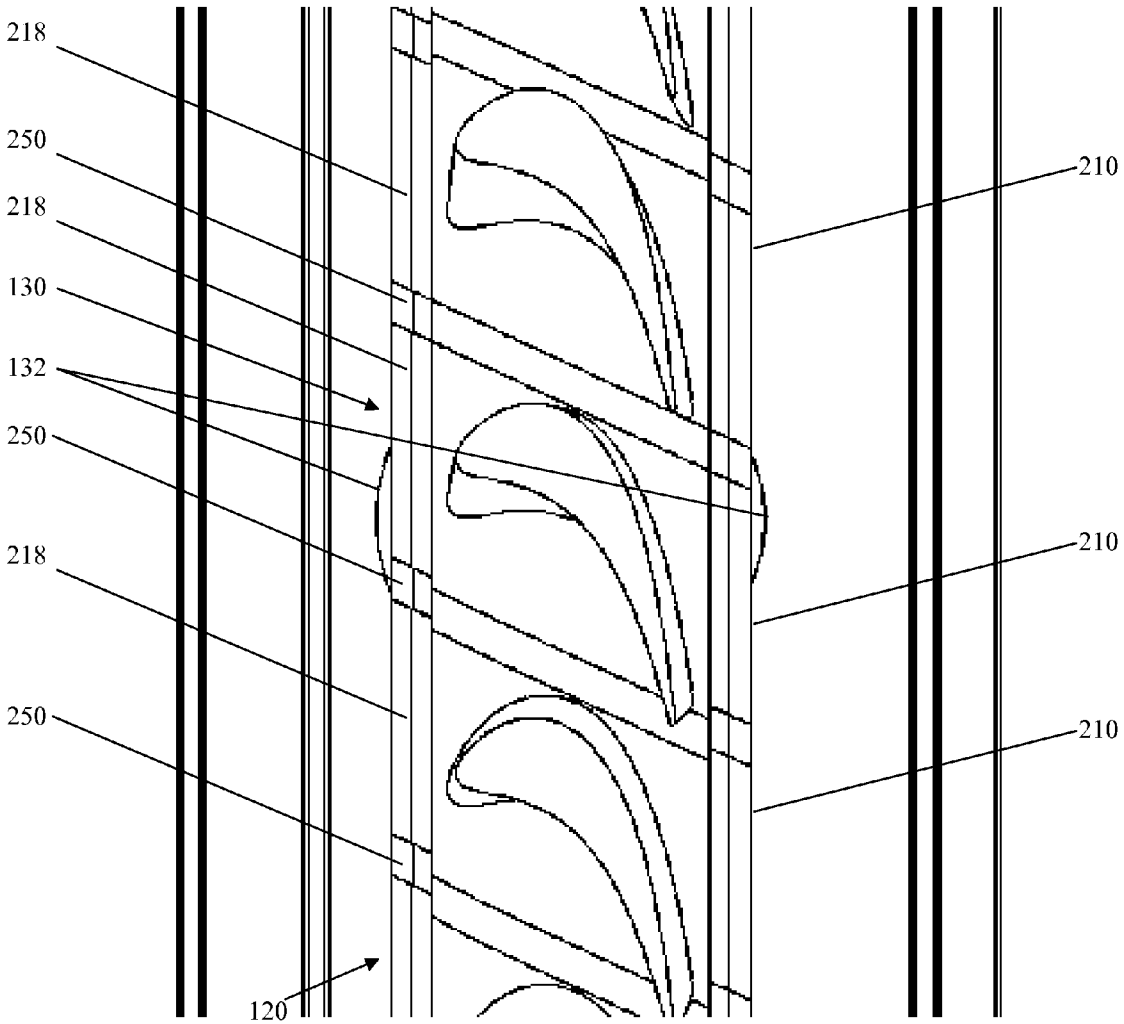
FIG. 17 is a schematic top view of the buckets of FIG. 16 with shims inserted between adjacent bucket dovetails according to embodiments of the invention disclosed herein.
Figure 18:
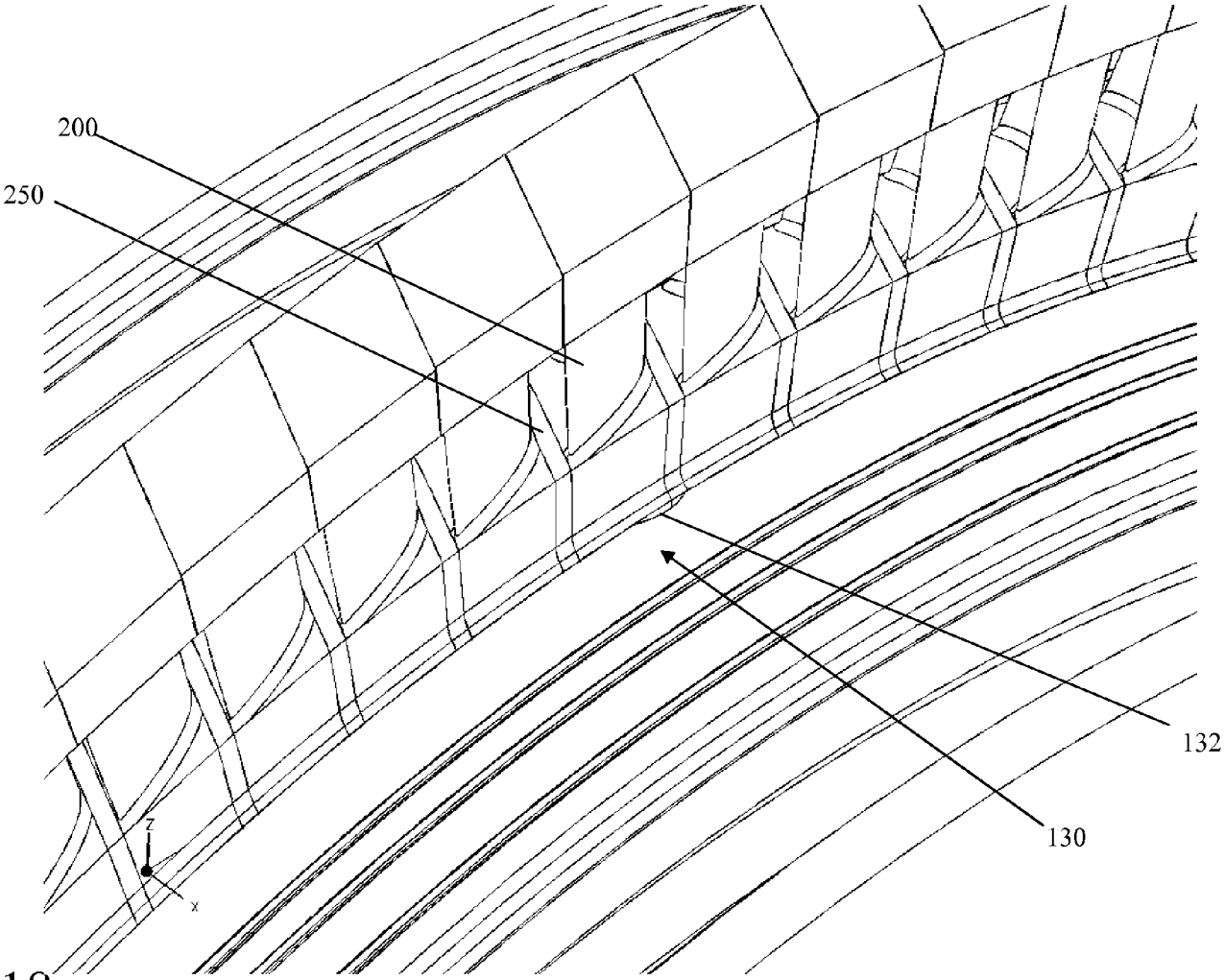
FIG. 18 is a schematic elevation of the buckets of FIG. 17 according to embodiments of the invention disclosed herein.

Each bucket 200 may be slid along dovetail groove 120, in second orientation 240, to a desired position, and another bucket 200 may be inserted. This may be repeated until all but a final desired bucket 200 have been inserted into and positioned along dovetail groove 120. As seen in FIG. 12, when all but a final bucket 200 have been inserted, buckets 200 already inserted may be pushed together and out of assembly gate 130 so that a final bucket 200 may be inserted. A final bucket 200 is shown in FIG. 13 inserted into dovetail groove 120 in a first orientation 230 and at a depth at which rotation will be possible and result in engagement of blade hook 212 with wheel neck shoulders 124. As in the examples above, final bucket 200 may be rotated from first orientation 230 toward second orientation 240, as seen in FIGS. 14 and 15. Once in second orientation 240, final bucket 200 and all other buckets may be repositioned so that their bucket dovetails 210 are substantially evenly spaced, as seen in FIG. 16, so that gaps 245 appear between adjacent bucket dovetails 210. Buckets 200 may then be secured, such as with shims 250 as shown in FIGS. 17 and 18 inserted in gaps 245 between bucket dovetails 210. Shims 250 may, for example, induce an interference fit between bucket dovetails 210 and/or blade hook arrangement or dovetail assembly 300. In embodiments, cover blocks 228 of adjacent blades 200 may be forced together, such as in an interference fit, to form a cover 230. For example, each cover block 228 may be formed with a rhomboid or parallelogram shaped cross section sized so that, in second orientation 240, each cover block 228 engages adjacent cover blocks 228 so that when a final bucket 200 is rotated into second orientation 240, an interference fit may be developed. While buckets 200 are secured once all are in position in this example, buckets 200 may be secured as they are positioned, once all are positioned, or in other manners as may be desired and/or appropriate.

With assembly gate 130 being formed in upper recessed areas 128, wheel neck shoulders 124 are left intact and substantially uniform throughout dovetail groove 120. Embodiments thus do not require cut-outs in wheel neck shoulders 124 and/or special blade attachment arrangements at assembly gate 130 as would be required by some existing solutions. This may, for example, enhance strength and structural integrity of rotor 100, and also may allow all rotor blades 200 in rotor 100 to be substantially identical, whereas existing solutions may require specialized rotor blade assemblies at assembly gates. In addition, assembly gate 130 may be sized so that it has a substantially negligible impact on balancing and natural frequencies of rotor 100, or so that compensation for presence of assembly gate 130 is easily achieved. Further, arrangements according to embodiments allow use of buckets 200 that are all substantially identical, thereby reducing manufacturing, handling, engineering, design, and other costs associated with typical arrangements requiring special buckets at assembly gates.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A blade mounting system comprising:

a blade including a bucket dovetail, the bucket dovetail including a blade hook portion;

a wheel dovetail groove formed in a rotor, the wheel dovetail groove having a shape complementary to a shape of the bucket dovetail and including an assembly gate, wherein the wheel dovetail groove includes a substantially circumferential groove in the rotor, a wheel hook portion configured to accommodate the blade hook portion of the bucket dovetail, opposed wheel neck shoulders formed in the groove so as to form a gap narrower than an opening of the groove and to engage the bucket dovetail blade hook portion, and opposed upper recessed areas at the opening of the groove, the assembly gate being a widened portion of the upper recessed areas; and the bucket dovetail being configured to have a first orientation in which the blade hook portion will fit through the assembly gate and a second orientation in which the blade hook portion is retained by the wheel dovetail groove, the bucket dovetail further being configured so that it may rotate between the first orientation and the second orientation at the assembly gate and be restrained against rotation at other locations in the wheel dovetail groove.

2. The blade mounting system of claim 1, wherein the widened portion includes opposed cut-outs each having a substantially arcuate profile.

3. The blade mounting system of claim 2, wherein the bucket dovetail blade hook portion includes opposed blade hook shoulders configured to be retained by the opposed wheel neck shoulders of the groove in the second orientation of the bucket dovetail.

4. The blade mounting system of claim 2, wherein the bucket dovetail includes opposed upper shoulders configured to sweep through the assembly gate cut-outs when the bucket dovetail is rotated into the second orientation and to be restrained against rotation by the upper recessed areas elsewhere in the groove.

5. The blade mounting system of claim 4, wherein the upper shoulders have a parallelogram shaped cross section and a diagonal of the cross section is substantially equal to twice a radius of curvature of a cut-out of the assembly gate.

6. The blade mounting system of claim 5, wherein the first orientation and the second orientation differ in a rotation of the bucket relative to the assembly gate and the wheel dovetail groove, the difference in rotation being equal to an angle of the cross section of the upper shoulders.

7. The blade mounting arrangement of claim 1, wherein the blade includes a body that extends from the bucket dovetail to a tip, the tip supporting a cover block configured to engage adjacent cover blocks of adjacent blades.

8. The blade mounting system of claim 7, further comprising shims inserted between adjacent bucket dovetails to press the bucket dovetails together.

9. A rotor blade mounting arrangement comprising:

a rotor including a substantially cylindrical surface;

a wheel dovetail formed in the rotor through the substantially cylindrical surface, the wheel dovetail including a substantially circumferential groove in the rotor, a wheel neck shoulder, and an upper recessed area at an opening of the groove;

a rotor blade including a bucket dovetail, the bucket dovetail being configured to support the rotor blade and to be retained against radial movement in and by the wheel dovetail;

a blade hook shoulder of the bucket dovetail configured to engage and be retained against exit from the wheel dovetail groove by the wheel neck shoulder;

an upper shoulder of the bucket dovetail configured to at least partly overlie the wheel neck shoulder;

an assembly gate including a cut-out formed in the upper recessed area of the wheel dovetail groove, the cut-out being configured to allow the blade hook shoulder to be inserted into the wheel dovetail groove in a first orientation of the bucket dovetail and to allow the upper shoulder to pass when the bucket dovetail is rotated into a second orientation.

10. The arrangement of claim 9, wherein the cut-out includes a substantially arcuate portion sized to accommodate the upper shoulder of the bucket dovetail.

11. The arrangement of claim 10, wherein the wheel dovetail groove includes opposed wheel neck shoulders and opposed upper recessed areas, the assembly gate includes opposed cut-outs including opposed arcuate portions, the bucket dovetail includes opposed upper shoulders, and the opposed arcuate portions are each configured to have a radius of curvature that is substantially half of a diagonal between a first pair of opposed corners of the upper shoulders.

12. The arrangement of claim 9, wherein the wheel dovetail includes an internal tangential dovetail.

13. The arrangement of claim 9, further comprising a cover block at a tip of the rotor blade.

14. The arrangement of claim 13, wherein the cover block is configured to engage an adjacent cover block of an adjacent rotor blade.

15. A rotor comprising:

a substantially cylindrical surface of a rotor body;

a wheel dovetail including a substantially circumferential groove in the substantially cylindrical surface;

a plurality of substantially identical rotor blades each comprising a bucket dovetail having blade hook portion with a first orientation in which the blade hook portion may be inserted into the groove and a second orientation in which the blade hook portion is retained in the groove and retained against rotation in the groove, each bucket dovetail comprising blade hook shoulders in the blade hook portion and upper shoulders in an upper portion of the bucket dovetail;

opposed wheel neck shoulders formed in the groove between a wheel hook portion of the groove and an upper portion of the groove, the wheel neck shoulders being configured to retain a respective blade hook portion of each rotor blade via respective blade hook shoulders;

opposed upper recessed areas formed in the top portion of the groove and configured to retain respective upper shoulders of each bucket dovetail against rotation;

an assembly gate in the groove configured to allow the upper shoulders of each bucket dovetail to pass when the bucket dovetail is rotated to a second orientation in which the bucket dovetail is retained in the groove.

16. The rotor of claim 15, wherein the assembly gate comprises opposed cut-outs formed in the upper recessed areas.

17. The rotor of claim 16 wherein the cut-outs each have an arcuate profile.

18. The rotor of claim 17, wherein each cut-out has a radius of curvature substantially equal to half a distance between opposed corners of the upper shoulders.

19. The rotor of claim 18, wherein the upper shoulders of each bucket dovetail have a parallelogram shaped cross section, and the distance between opposed corners of the upper shoulders is a diagonal of the cross section.

* * * * *